US005397057A

United States Patent [19]

Verstraeten

[11] Patent Number: 5,397,057

[45] Date of Patent: Mar. 14, 1995

[54] LANCE MACHINE WITH FLEXIBLE LANCE

[75] Inventor: Paul Verstraeten, Terneuzen, Netherlands

[73] Assignee: Peinemann Equipment B.V., Netherlands

[21] Appl. No.: 156,373

[22] Filed: Nov. 22, 1993

[30] Foreign Application Priority Data

Dec. 16, 1992 [NL] Netherlands ..... 9202174

[51] Int. Cl.[6] ..... B08B 3/02

[52] U.S. Cl. ..... 239/198; 239/197; 122/379; 122/392; 134/167 C; 242/390.3; 242/566; 242/615.3

[58] Field of Search ..... 239/195, 197, 198, 225.1, 239/227; 122/379, 390, 391, 392; 134/167 C, 168 C, 169 C; 242/157 R, 390.3, 391.3, 541.3, 566, 615.3

[56] References Cited

U.S. PATENT DOCUMENTS

| | | | |
|---|---|---|---|
| 4,103,841 | 8/1978 | Flynn et al. | 242/390.3 |
| 4,144,898 | 3/1979 | Guignon et al. | 239/227 |
| 4,179,056 | 12/1979 | Schmerling | 226/171 |
| 4,389,868 | 6/1983 | Strout | 242/541.3 |
| 4,531,682 | 7/1985 | Schroder et al. | 242/615.3 |
| 4,844,021 | 7/1989 | Stoss | 134/167 C |
| 5,002,120 | 3/1991 | Boisture et al. | 122/391 |
| 5,067,558 | 11/1991 | Boisture | 134/167 C |
| 5,184,636 | 2/1993 | Van der Woude | 122/379 |
| 5,320,072 | 6/1994 | Theiss et al. | 122/392 |

FOREIGN PATENT DOCUMENTS

| | | | |
|---|---|---|---|
| 0446653 | 9/1991 | European Pat. Off. . | |
| 0473234 | 3/1992 | European Pat. Off. . | |
| 2625737 | 7/1989 | France . | |
| 3238602 | 4/1984 | Germany | 134/167 C |

*Primary Examiner*—Andres Kashnikow
*Assistant Examiner*—Christopher G. Trainor
*Attorney, Agent, or Firm*—Mark Zovko

[57] ABSTRACT

The invention relates to a lance device comprising a frame, a drum mounted rotatably on the frame, at least one hose arranged on the drum, containing means provided with a passage for containing the hose while lying on the drum, connecting means for connecting a source of liquid under high pressure to an end of the hose joined to the drum and drive means for driving the drum in rotation. The containing means comprise an endless flexible member and guide means therefor which guide the flexible member in a path from one side of the passage round the drum and lying thereagainst to the other side of the passage and therefrom at a distance from the drum in opposite direction back to the one side of the passage.

6 Claims, 2 Drawing Sheets

LANCE MACHINE WITH FLEXIBLE LANCE

The invention relates to a lance device such as a lance device for cleaning pipe bundles of heat exchangers.

A known lance machine of the present type is made commercially available by applicant under the designation "Heat-exchanger Bundle Cleaner (HBC)". With such a device a number of hoses wound onto a drum and connected onto a source of water under high pressure are inserted into a number of pipes of a pipe bundle to jet loose deposits present therein. The hoses are pushed into the pipes with a positive pressure by unwinding the drum in driven manner.

The hoses are herein contained on the drum by containing means in the form of a number of rollers which are mounted parallel to the drum and which lie with their surface against the hoses wound onto the drum. Because the hoses are pushed into the pipes with a positive pressure and not, as was previously usual, pulled inward into the pipes through rearward oriented bores in jet nozzles at the end of the hoses, the water fed at high pressure is utilized with greater efficiency. This known device therefore operates more rapidly and better than previously known devices of this type.

The device characterized in claim 1 is a further improvement. Because the containing means in the form of the endless flexible member move together with the movement of the drum there is no resulting friction on the hoses. The life-span of the hoses is hereby increased considerably. Moreover, the total friction during rotation of the drum is very small when there is proper mounting of the guide means, whereby the drive means require only little power.

In preference the step of claim 2 is applied. The flanges herein form as it were the holding means for the flexible member so that the height of the space between the drum surface and the flexible member can be held constant. The state of tension of the flexible member can hereby be held precisely under control.

A favourable embodiment is characterized in claim 3. With this embodiment the flexible member can have a great stiffness in transverse direction and still be completely flexible in longitudinal direction.

With the further development of claim 4 a very good guiding of the flexible member can be obtained.

By applying the step of claim 5 the friction resulting from the movement of the flexible member can be wholly absorbed by these additional drive means so that the driving of the drum, with which the pushing force for the lances is generated, is not affected by possible friction in the guiding of the flexible member.

Further features and advantages of the invention will become apparent from the following description of several embodiments with reference to the annexed drawings.

Figure 1:
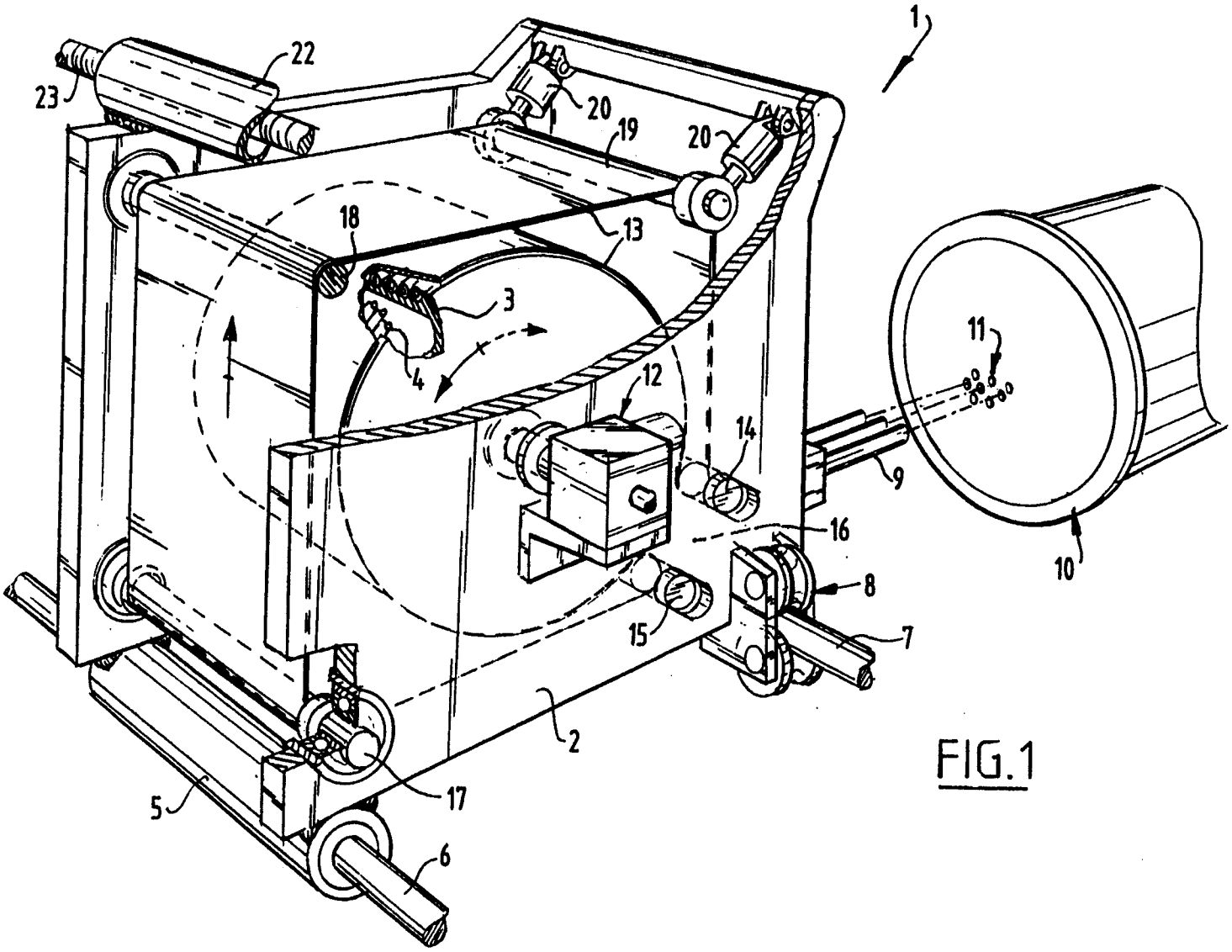
FIG. 1 shows a first embodiment of the device according to the invention in partially schematic and broken away perspective view.

The lance device 1 shown in FIG. 1 comprises a drum 3 which is mounted in a sub-frame 2 and onto which is wound at least one high-pressure hose 4. In this embodiment three hoses are wound together onto the drum 3.

The sub-frame 2 is mounted slidably in transverse direction in a main frame (not shown). Fixedly connected to this main frame are rods 6, 7 onto which engage respectively a transverse guide and guide pulleys 8 of the sub-frame 2. The transverse displacement of the sub-frame with the drum 3 relative to the main frame is brought about by a rotatably driven screw spindle 23 which engages into a screwed sleeve fixedly connected to sub-frame 2.

The drum 3 is driven rotatably using a drive device 12 which may for instance comprise a hydraulic or pneumatic motor. The drive 12 is coupled in a manner not further shown to the drive of the screw spindle 23 such that, when the drum is rotated through one full revolution, the whole frame 2 is displaced sideways through a distance equal to the width occupied by three mutually adjacent hoses 4 on the drum 3. The position where the hoses unwind from and wind onto the drum hereby remains at the same location in transverse direction relative to the main frame.

Placed in front of the position where the hoses unwind from and wind onto the drum is a longitudinal guide 9 through which the hoses are guided. The longitudinal guide 9 is adjusted such that the outlets thereof come to lie at distances corresponding with the mutual distance of the pipes 11 in a pipe bundle 10 for cleaning. During unwinding from the drum 3 the lances formed by hoses 4 are thus pushed via the longitudinal guide 9 into the pipes 11. The other end of the hoses is coupled in per se known manner to the shaft of drum 3 to which is connected a feed for water under high pressure. This water under high pressure jets outward at the forward end of the lances so that when these lances are inserted into the pipes 11 deposits present therein can be sprayed loose and flushed away.

In the device 1 the lances are pushed into the pipes 11 with a positive pressure which is generated by the rotation of the drive 12. Because a part of the liquid supplied under pressure is not used to guide the lances into the pipes 11, as in the known art wherein rearwardly directed channels are arranged in jet nozzles, the full power of the liquid under pressure can be used for jet cleaning the pipes 11.

The hoses are thus subjected during operation to a pressure force directed in a longitudinal direction. This pressure force would tend to lift the hose from the drum 3. In order to prevent this, containing means are arranged which according to the invention take the form of an endless member 13 in the form of an endless belt which lies on the drum 3 over the greater part of the periphery. Only a portion of the periphery between two guide rollers 14 and 15 which forms a passage 16 is left open by the endless belt 13.

The endless belt 13 is thus guided from the guide 14 above the passage 16 around the drum 3 to the guide 15 below passage 16, from guide 15 round guides 17, 18 and 19 arranged in the sub-frame back again to the guide 14. In the path round the guides 15, 17, 18 and 19 the belt 13 therefore extends at a distance from drum 3 and moves in a direction opposed to that of the drum surface.

The guides 14, 15, 17, 18, 19 are formed by rollers which are mounted in the frame 2 which thus produce a small frictional resistance.

The endless member 13 is held tensioned by cylinders 20 connected to roller 19, which may be hydraulic or pneumatic cylinders and be under an adjustable pressure so that the tension of the endless wall 13 can be set to a determined desired value and held constant. During winding and unwinding of the hoses 4 onto and from drum 3 there thus occurs no relative movement whatever between hose 4, drum 3 and the flexible member 13, and in particular no movement between the surface of the hoses 4 and the flexible member 13, so that the hose is safeguarded to a very considerable extent against wear.

As shown in FIG. 1, the flexible member 13 can be a belt of random material such as reinforced plastic or stainless steel. The belt 13 can in suitable manner also be a toothed belt. Herein the rollers 14, 15, 17, 18, 19 are then toothed belt rollers. The smooth surface of the toothed belt then faces outward and toward the drum.

Figures 2, 3:
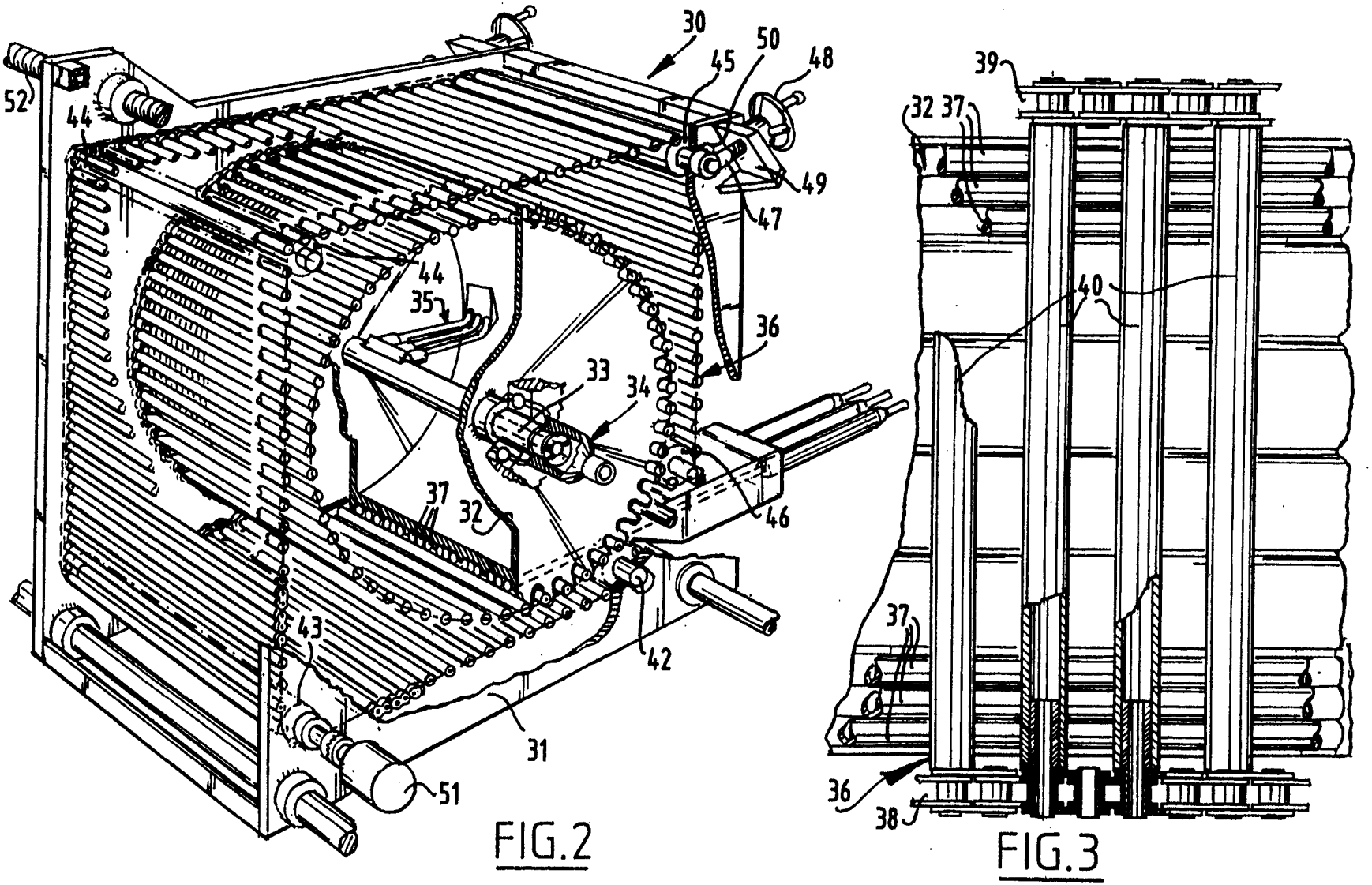
FIG. 2 shows a view corresponding with FIG. 1 of a preferred embodiment of the device.
FIG. 3 shows a partly broken away view onto the drum of the device of FIG. 2.

FIG. 2 shows another embodiment of the flexible member, wherein this flexible member 36 is constructed from two chains 38, 39 having rods 40 arranged therebetween. These rods engage rotatably into links of the chains 38, 39.

Also in the case of device 30 of FIG. 2 the drum 32 is mounted in a sub-frame 31 which can be displaceable in transverse direction in the manner described. The shaft 33 of drum 32 takes a hollow form and comprises a feed channel for the liquid under pressure which is supplied to that channel by means of a coupling 34. The ends of the hoses 37 connected to the drum are joined by means of connections 35 to the channel in shaft 33.

The flexible member 36 is guided in the device 30 in similar manner as in the device of FIG. 1. Here also are guides 42, 43, 44, 45, 46 which define the drawn path of the flexible member. Since the flexible member 36 is constructed from chains 38, 39 and rods 40, these guides can favourably contain chain wheels which ensure an accurate guiding of the whole flexible member with minimum friction. The flexible member 36 is held at the correct tension by means of the guide 45 which is slidable transversely of its axis of rotation in slots 50 in frame 31. Engaging on the ends of guide 45 are screw spindles 47 which are inserted through supports 49 of the frame 31 and onto which engage screw wheels 48. By tightening the screw wheel 48 the guide 45 is pulled away from the drum whereby the flexible member is tensioned.

The drum 32 has flanges which in this embodiment are provided with recesses in which the rods 40 of flexible member 36 come to rest. The position of the rods relative to drum 32 is hereby accurately determined so that the space in which the hoses 37 are contained is likewise precisely determined. Instead of the rods 40 falling into the shown recesses, the flanges can also be embodied as chain wheel, wherein the chains 38, 39 then run over these flanges.

In the device 30 additional drive means are arranged for the flexible member in the form of a motor 51 engaging onto the guide 43. This motor 51 can be a hydromotor or pneumatic motor and can be intended exclusively for absorbing the friction in the movement of the flexible member.

Alternatively, the motor 51 can also form the main drive means for the whole device. Through the action of drive motor 51 the flexible member 36 is then driven and this in turn drives the drum 36 due to the engagement of the rods in the flanges of drum 32. The transverse adjustment can of course also be provided herein by this drive. The screw spindle 52 corresponding with the screw spindle 23 shown in FIG. 1 is therein mounted fixedly in the main frame and on the sub-frame 31 is mounted a chain wheel which is in engagement with a chain 38, 39 and rotates a screwed sleeve engaging on the screw spindle 52. With a suitable calculation of the pitch of the screw thread 52 and the number of teeth of the relevant chain wheel, the transverse movement can be fully geared to the rotational movement in the above described manner.

Although the invention is described here in specific use for a cleaning lance machine for pipe bundles, it can also be applied in other devices in which one or more hoses which are wound onto a drum and pressure loaded in longitudinal direction in one manner or another must be contained on this drum. With the invention a construction is herein obtained wherein the hose is exposed to minimum wear and wherein moreover the drive forces for winding up and unwinding the hose undergo minimal friction.

I claim:

1. Lance device comprising a frame, a drum mounted rotatably on the frame, at least one hose arranged on the drum, containing means provided with a passage for containing the hose while lying on the drum, connecting means for connecting a source of liquid under high pressure to an end of the hose joined to the drum and drive means for driving the drum in rotation, wherein the containing means comprise an endless flexible member and guide means therefor which guide the flexible member in a path from one side of the passage round the drum and lying thereagainst to the other side of the passage and therefrom at a distance from the drum in opposite direction back to the one side of the passage.

2. Lance device as claimed in claim 1, wherein the drum comprises flanges whereof the outer periphery of the flange lies at substantially the same diameter as the outer periphery of the hose wound onto the drum and wherein the flexible member lies on the flanges.

3. Lance device as claimed in claim 1, wherein the endless flexible member is assembled from two chains at a distance and mutually parallel and rod-like elements connected with their ends to these chains.

4. Lance device as claimed in claim 3, wherein the guide means comprise chain wheels co-acting with the chains.

5. Lance device as claimed in claim 4 comprising additional drive means engaging onto the flexible member.

6. Lance device as claimed in claim 1, wherein the guide means comprise a number of guide rollers or wheels which are mounted rotatably on the frame and at least one of which is mounted for displacement transversely of its axis of rotation for tensioning the flexible member.

* * * * *